US007949522B2

(12) United States Patent
Hetherington et al.

(10) Patent No.: US 7,949,522 B2
(45) **Date of Patent: *May 24, 2011**

(54) SYSTEM FOR SUPPRESSING RAIN NOISE

(75) Inventors: Phillip A. Hetherington, Port Moody (CA); Adrian R. Groves, Surrey (CA)

(73) Assignee: QNX Software Systems Co., Ottawa, Ontario (CA)

( * ) Notice: Subject to any disclaimer, the term of this patent is extended or adjusted under 35 U.S.C. 154(b) by 942 days.

This patent is subject to a terminal disclaimer.

(21) Appl. No.: 11/006,935

(22) Filed: Dec. 8, 2004

(65) Prior Publication Data

US 2005/0114128 A1 May 26, 2005

Related U.S. Application Data

(63) Continuation-in-part of application No. 10/688,802, filed on Oct. 16, 2003, which is a continuation-in-part of application No. 10/410,736, filed on Apr. 10, 2003.

(60) Provisional application No. 60/449,511, filed on Feb. 21, 2003.

(51) Int. Cl.
*G10L 21/02* (2006.01)

(52) U.S. Cl. ..... 704/226

(58) Field of Classification Search ..... 704/226, 704/233

See application file for complete search history.

(56) References Cited

U.S. PATENT DOCUMENTS 4,486,900 A 12/1984 Cox et al.
4,531,228 A 7/1985 Noso et al.
4,630,304 A 12/1986 Borth et al.
4,630,305 A 12/1986 Borth et al.
4,811,404 A * 3/1989 Vilmur et al. ..... 381/94.3
4,843,562 A 6/1989 Kenyon et al.
4,845,466 A 7/1989 Hariton et al.
5,012,519 A 4/1991 Adlersberg et al.
5,027,410 A 6/1991 Williamson et al.
5,056,150 A 10/1991 Yu et al.
5,146,539 A 9/1992 Doddington et al.
5,251,263 A 10/1993 Andrea et al.
5,313,555 A 5/1994 Kamiya
5,400,409 A 3/1995 Linhard
5,426,703 A 6/1995 Hamabe et al.

(Continued)

FOREIGN PATENT DOCUMENTS

CA 2158847 9/1994

(Continued)

OTHER PUBLICATIONS

An improved (Auto:I, LSP:T) constrained iterative speech enhancement for colored noise environments Pellom, B.L.; Hansen, J.H.L.; Speech and Audio Processing, IEEE Transactions on vol. 6, Issue 6, Nov. 1998 pp. 573-579.*

(Continued)

*Primary Examiner* — Michael N Opsasnick
(74) *Attorney, Agent, or Firm* — Brinks Hofer Gilson & Lione

(57) ABSTRACT

A voice enhancement logic improves the perceptual quality of a processed signal. The voice enhancement system includes a noise detector and a noise attenuator. The noise detector detects and models the noise associated with rain. The noise attenuator dampens or reduces the rain noise from a signal to improve the intelligibility of an unvoiced, a fully voiced, or a mixed voice segment.

39 Claims, 16 Drawing Sheets

U.S. PATENT DOCUMENTS

| | | | | |
|---|---|---|---|---|
| 5,426,704 | A | 6/1995 | Tamamura et al. | |
| 5,442,712 | A | 8/1995 | Kawamura et al. | |
| 5,479,517 | A | 12/1995 | Linhard | |
| 5,485,522 | A | 1/1996 | Sölve et al. | |
| 5,495,415 | A | 2/1996 | Ribbens et al. | |
| 5,502,688 | A | 3/1996 | Recchione et al. | |
| 5,526,466 | A | 6/1996 | Takizawa | |
| 5,550,924 | A | 8/1996 | Helf et al. | |
| 5,568,559 | A | 10/1996 | Makino | |
| 5,584,295 | A | 12/1996 | Muller et al. | |
| 5,586,028 | A | 12/1996 | Sekine et al. | |
| 5,617,508 | A | 4/1997 | Reaves | |
| 5,651,071 | A | 7/1997 | Lindemann et al. | |
| 5,677,987 | A | 10/1997 | Seki et al. | |
| 5,680,508 | A | 10/1997 | Liu | |
| 5,692,104 | A | 11/1997 | Chow et al. | |
| 5,701,344 | A | 12/1997 | Wakui | |
| 5,727,072 | A | 3/1998 | Raman | |
| 5,752,226 | A | 5/1998 | Chan et al. | |
| 5,809,152 | A | 9/1998 | Nakamura et al. | |
| 5,839,101 | A | 11/1998 | Vahatalo et al. | |
| 5,859,420 | A | 1/1999 | Borza | |
| 5,878,389 | A | 3/1999 | Hermansky et al. | |
| 5,920,834 | A | 7/1999 | Sih et al. | |
| 5,933,495 | A | 8/1999 | Oh | |
| 5,933,801 | A | 8/1999 | Fink et al. | |
| 5,949,888 | A | 9/1999 | Gupta et al. | |
| 5,982,901 | A | 11/1999 | Kane et al. | |
| 6,011,853 | A | 1/2000 | Koski et al. | |
| 6,108,610 | A | 8/2000 | Winn | |
| 6,122,384 | A | 9/2000 | Mauro | |
| 6,130,949 | A | 10/2000 | Aoki et al. | |
| 6,163,608 | A | 12/2000 | Romesburg et al. | |
| 6,167,375 | A | 12/2000 | Miseki et al. | |
| 6,173,074 | B1 | 1/2001 | Russo | |
| 6,175,602 | B1 | 1/2001 | Gustafsson et al. | |
| 6,192,134 | B1 | 2/2001 | White et al. | |
| 6,199,035 | B1 | 3/2001 | Lakaniemi et al. | |
| 6,208,268 | B1 | 3/2001 | Scarzello et al. | |
| 6,230,123 | B1 | 5/2001 | Mekuria et al. | |
| 6,252,969 | B1 | 6/2001 | Ando | |
| 6,289,309 | B1 | 9/2001 | deVries | |
| 6,405,168 | B1 | 6/2002 | Bayya et al. | |
| 6,415,253 | B1 | 7/2002 | Johnson | |
| 6,434,246 | B1 | 8/2002 | Kates et al. | |
| 6,453,285 | B1 | 9/2002 | Anderson et al. | |
| 6,507,814 | B1 | 1/2003 | Gao | |
| 6,510,408 | B1 | 1/2003 | Hermansen | |
| 6,587,816 | B1 | 7/2003 | Chazan et al. | |
| 6,615,170 | B1 * | 9/2003 | Liu et al. | 704/233 |
| 6,643,619 | B1 | 11/2003 | Linhard et al. | |
| 6,647,365 | B1 | 11/2003 | Faller | |
| 6,687,669 | B1 | 2/2004 | Schrögmeier et al. | |
| 6,711,536 | B2 | 3/2004 | Rees | |
| 6,741,873 | B1 * | 5/2004 | Doran et al. | 455/569.1 |
| 6,766,292 | B1 * | 7/2004 | Chandran et al. | 704/224 |
| 6,768,979 | B1 | 7/2004 | Menendez-Pidal et al. | |
| 6,782,363 | B2 | 8/2004 | Lee et al. | |
| 6,822,507 | B2 | 11/2004 | Buchele | |
| 6,859,420 | B1 * | 2/2005 | Coney et al. | 367/178 |
| 6,882,736 | B2 | 4/2005 | Dickel et al. | |
| 6,910,011 | B1 | 6/2005 | Zakarauskas | |
| 6,937,980 | B2 * | 8/2005 | Krasny et al. | 704/231 |
| 6,959,276 | B2 | 10/2005 | Droppo et al. | |
| 7,043,030 | B1 | 5/2006 | Furuta | |
| 7,047,047 | B2 * | 5/2006 | Acero et al. | 455/563 |
| 7,062,049 | B1 | 6/2006 | Inoue et al. | |
| 7,072,831 | B1 | 7/2006 | Etter | |
| 7,092,877 | B2 | 8/2006 | Ribic | |
| 7,117,145 | B1 | 10/2006 | Venkatesh et al. | |
| 7,117,149 | B1 | 10/2006 | Zakarauskas | |
| 7,158,932 | B1 | 1/2007 | Furuta | |
| 7,165,027 | B2 * | 1/2007 | Kellner et al. | 704/233 |
| 7,313,518 | B2 | 12/2007 | Scalart et al. | |
| 7,373,296 | B2 | 5/2008 | Van De Par et al. | |
| 7,386,217 | B2 | 6/2008 | Zhang | |
| 2001/0028713 | A1 | 10/2001 | Walker | |
| 2002/0037088 | A1 | 3/2002 | Dickel et al. | |
| 2002/0071573 | A1 | 6/2002 | Finn | |
| 2002/0094100 | A1 | 7/2002 | Kates et al. | |
| 2002/0094101 | A1 | 7/2002 | De Roo et al. | |
| 2002/0176589 | A1 | 11/2002 | Buck et al. | |
| 2003/0040908 | A1 * | 2/2003 | Yang et al. | 704/233 |
| 2003/0147538 | A1 | 8/2003 | Elko | |
| 2003/0151454 | A1 * | 8/2003 | Buchele | 327/551 |
| 2003/0216907 | A1 | 11/2003 | Thomas | |
| 2004/0078200 | A1 | 4/2004 | Alves | |
| 2004/0093181 | A1 | 5/2004 | Lee | |
| 2004/0138882 | A1 | 7/2004 | Miyazawa | |
| 2004/0161120 | A1 | 8/2004 | Petersen et al. | |
| 2004/0165736 | A1 | 8/2004 | Hetherington et al. | |
| 2004/0167777 | A1 | 8/2004 | Hetherington et al. | |
| 2005/0238283 | A1 | 10/2005 | Faure et al. | |
| 2005/0240401 | A1 | 10/2005 | Ebenezer | |
| 2006/0034447 | A1 | 2/2006 | Alves et al. | |
| 2006/0074646 | A1 | 4/2006 | Alves et al. | |
| 2006/0100868 | A1 | 5/2006 | Hetherington et al. | |
| 2006/0115095 | A1 | 6/2006 | Glesbrecht et al. | |
| 2006/0116873 | A1 | 6/2006 | Hetherington et al. | |
| 2006/0136199 | A1 | 6/2006 | Nongpiur et al. | |
| 2006/0251268 | A1 | 11/2006 | Hetherington et al. | |
| 2006/0287859 | A1 | 12/2006 | Hetherington et al. | |
| 2007/0019835 | A1 | 1/2007 | Ivo De Roo et al. | |
| 2007/0033031 | A1 | 2/2007 | Zakarauskas | |

FOREIGN PATENT DOCUMENTS

| | | | |
|---|---|---|---|
| CA | 2157496 | | 10/1994 |
| CA | 2158064 | | 10/1994 |
| CN | 1325222 | A | 12/2001 |
| EP | 0 076 687 | A1 | 4/1983 |
| EP | 0 629 996 | A2 | 12/1994 |
| EP | 0 629 996 | A3 | 12/1994 |
| EP | 0 750 291 | A1 | 12/1996 |
| EP | 1 450 353 | A1 | 2/2004 |
| EP | 1 450 354 | A1 | 2/2004 |
| EP | 1 669 983 | A1 | 6/2006 |
| JP | 64-039195 | | 2/1989 |
| JP | 06269084 | | 9/1994 |
| JP | 6282297 | | 10/1994 |
| JP | 06-319193 | | 11/1994 |
| JP | 06319193 | | 11/1994 |
| JP | 6349208 | | 12/1994 |
| JP | 2001215992 | | 8/2001 |
| WO | WO 00-41169 | A1 | 7/2000 |
| WO | WO 0156255 | A1 | 8/2001 |
| WO | WO 01-73761 | A1 | 10/2001 |

OTHER PUBLICATIONS

Vaseghi, "Advanced Digital Signal Processing and Noise Reduction", Publisher, John Wiley & Sons Ltd., 2000, pp. 1-28, 333-354, and 378-395.

Boll, "Suppression of Acoustic Noise in Speech Using Spectral Subtraction", IEEE Trans. On Acoustics, Speech, and Signal Processing, Apr. 1979, pp. 113-120.

Berk et al., "Data Analysis with Microsoft Excel", Duxbury Press, 1998, pp. 236-239 and 256-259.

Seely, S., "An Introduction to Engineering Systems", Pergamon Press Inc., 1972, pp. 7-10.

Avendano, C., Hermansky, H., "Study on the Dereverberation of Speech Based on Temporal Envelope Filtering," Proc. ICSLP '96, pp. 889-892, Oct. 1996.

Fiori, S., Uncini, A., and Piazza, F., "Blind Deconvolution by Modified Bussgang Algorithm", Dept. of Electronics and Automatics—University of Ancona (Italy), ISCAS 1999.

Learned, R.E. et al., A Wavelet Packet Approach to Transient Signal Classification, Applied and Computational Harmonic Analysis, Jul. 1995, pp, 265-278, vol. 2, No. 3, USA, XP 000972660. ISSN: 1063-5203. abstract.

Nakatani, T., Miyoshi, M., and Kinoshita, K., "Implementation and Effects of Single Channel Dereverberation Based on the Harmonic Structure of Speech," Proc. Of IWAENC-2003, pp. 91-94, Sep. 2003.

Quatieri, T.F. et al., Noise Reduction Using a Soft-Dection/Decision Sine-Wave Vector Quantizer, International Conference on Acoustics, Speech & Signal Processing, Apr. 3, 1990, pp. 821-824, Vol. Conf. 15, IEEE ICASSP, New York, US XP000146895, Abstract, Paragraph 3.1.
Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.
Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.
Vieira, J., "Automatic Estimation of Reverberation Time", Audio Engineering Society, Convention Paper 6107, 116th Convention, May 8-11, 2004, Berlin, Germany, pp. 1-7.
Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.
Puder, H. et al. "Improved Noise Reduction for Hands-Free Car Phones Utilizing Information on Vehicle and Engine Speeds", Finland Abstract, Tampere Univ. Technology, Tampere, Finland, Sep. 4-8, 2000, vol. 3, XP009030255, pp. 1851-1854.
Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.
Shust, Michael R. And Rogers, James C., "Electronic Removal of Outdoor Microphone Wind Noise", obtained from the Internet on Jul. 28, 2004 at: <http://www.acounstics.org/press/136th/mshust.htm>, 6 pages.
Wahab A., et al. "Intelligent Dashboard With Speech Enhancement", Information, Communications and Signal Processing, 1997, ICICS, Proceedings of International Conference on Singapore Sep. 9-12, 1997, *IEEE*, pp. 993-997.
Boll, S. F., "Suppression of Acoustic Noise in Speech Using Spectral Subtraction," *IEEE Trans. On Acoustics, Speech, and Signal Processing*, vol. ASSP-27, No. 2, 1979, pp. 113-120.
Ephraim, Y., "Statistical-Model-Based Speech Enhancement Systems," *IEEE*, vol. 80, No. 10, 1992, pp. 1526-1555.
Godsill, S. et al., "Digital Audio Restoration," Department of Engineering, University of Cambridge, 1997, pp. 1-71.
Ljung, L., Chapter 1, "Introduction," *System Identification Theory for the User, 2nd* ed., Prentice Hall, Upper Saddle River, New Jersey, Copyright 1999, pp. 1-14.
Pellom, B. et al., "An Improved (Auto:I, LSP:T) Constrained Iterative Speech Enhancement for Colored Noise Environments," *IEEE Trans. On Speech and Audio Processing*, vol. 6, No. 6, 1998, pp. 573-579.
Vaseghi, S. V., Chapter 12 "Impulsive Noise," *Advanced Digital Signal Processing and Noise Reduction, 2nd* ed., John Wiley and Sons, Copyright 2000, pp. 355-377.
Udrea, R. M. et al., "Speech Enhancement Using Spectral Over-Subtraction and Residual Noise Reduction," IEEE, 2003, pp. 165-168.

* cited by examiner

SYSTEM FOR SUPPRESSING RAIN NOISE

PRIORITY CLAIM

This application is a continuation in-part of U.S. application Ser. No. 10/688,802 "System for Suppressing Wind Noise," filed Oct. 16, 2003, which is a continuation in-part of U.S. application Ser. No. 10/410,736, "Method and Apparatus for Suppressing Wind Noise," filed Apr. 10, 2003, which claims priority to U.S. application Ser. No. 60/449,511 "Method for Suppressing Wind Noise" filed on Feb. 21, 2003. The disclosures of the above applications are incorporated herein by reference.

BACKGROUND OF THE INVENTION

1. Technical Field

This invention relates to acoustics, and more particularly, to a system that enhances the perceptual quality of sound by reducing interfering noise.

2. Related Art

Many hands-free communication devices acquire, assimilate, and transfer a voice signal. Voice signals pass from one system to another through a communication medium. In some systems, including those used in vehicles, the clarity of a voice signal does not depend on the quality of the communication system or the quality of the communication medium. When noise occurs near a source or a receiver, distortion may interfere with the voice signal, destroy information, and in some instances, masks the voice signal so that it cannot be recognized.

Noise may come from many sources. In a vehicle, noise may be created by the engine, the road, the tires, or by the surrounding environment. When rain falls onto a vehicle it produces noise that may be heard across a broad frequency spectrum. Some aspects of this noise are predictable, while others are random.

Some systems attempt to counteract the effects of rain noise by insulating vehicles with a variety of sound-suppressing and dampening materials. While these materials are effective in reducing some noises, the materials also absorb desired signals and do not block the rain noise that may mask a portion of the audio spectrum. Another problem with some speech enhancement systems is that of detecting rain noise. Yet another problem with some speech enhancement systems is that they do not easily adapt to other communication systems.

Therefore there is a need for a system that counteracts the noise associated with water striking a surface across a varying frequency range.

SUMMARY

This invention provides a voice enhancement logic that improves the perceptual quality of a processed voice. The system learns, encodes, and then dampens the noise associated with water striking a surface that includes the surface of a vehicle. The system includes a noise detector and a noise attenuator. The noise detector detects noise associated with falling water, such as the noise that may be heard during a rainstorm. The noise attenuator dampens or reduces some of the detected rain noise.

Alternative voice enhancement logic includes time frequency transform logic, a background noise estimator, a rain noise detector, and a rain noise attenuator. The time frequency transform logic converts a time varying input signal into a frequency domain output signal. The background noise estimator measures the continuous noise that may accompany the input signal. The rain noise detector automatically identifies and models some of the noise associated with rain, which is then dampened or reduced by the rain noise attenuator.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A voice enhancement logic improves the perceptual quality of a processed voice. The logic may automatically learn and encode the shape and form of the noise associated with rain in a real or a delayed time. By tracking selected attributes, the logic may substantially eliminate or dampen rain noise using a memory that temporarily stores the selected attributes of the noise. Alternatively, the logic may also dampen a continuous noise and/or the "musical noise," squeaks, squawks, chirps, clicks, drips, pops, tones, or other sound artifacts that may be generated by some voice enhancement systems.

Figure 1:
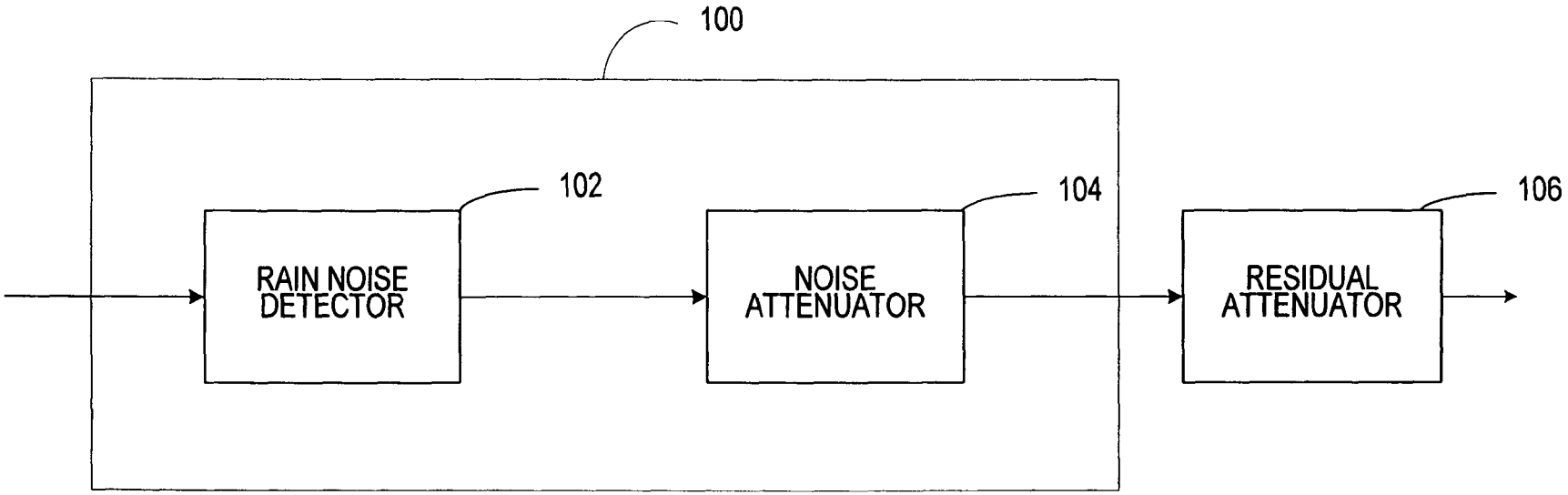
FIG. 1 is a partial block diagram of voice enhancement logic.

FIG. 1 is a partial block diagram of the voice enhancement logic 100. The voice enhancement logic 100 may encompass hardware or software that is capable of running on one or more processors in conjunction with one or more operating systems. The highly portable logic includes a rain noise detector 102 and a noise attenuator 104.

In FIG. 1 the rain noise detector 102 may identify and model a noise associated with rain that falls onto or strikes a surface. While rain noise may occur across a broad frequency spectrum, the rain noise detector 102 is configured to detect and model the rain noise that is perceived by the ear. The rain noise detector 102 receives incoming sound, that in the short term spectra, may be classified into three broad categories: (1) unvoiced, which exhibits noise-like characteristics that may include the noise associated with rain, e.g., it may have some spectral shape but no harmonic or formant structure; (2) fully voiced, which exhibits a regular harmonic structure, or peaks at pitch harmonics weighted by the spectral envelope that may describe the formant structure, and (3) mixed voice, which exhibits a mixture of the above two categories, some parts containing noise-like segments that may include rain noise, the rest exhibiting a regular harmonic structure and/or a formant structure.

The rain noise detector 102 may separate the noise-like segments from the remaining signal in a real or in a delayed time no matter how complex or how loud an incoming noise segment may be. The separated noise-like segments are analyzed to detect the occurrence of rain noise, and in some instances, the presence of a continuous underlying noise. When rain noise is detected, the spectrum is modeled, and the model is retained in a memory. While the rain noise detector 102 may store an entire model of a rain noise signal, it also may store selected attributes in a memory. Some selected attributes may model the noise created by rain striking a surface, the peripheral noise (e.g. in vehicle noise) that may be heard in a rainstorm, or a combination thereof.

To overcome the effects of rain noise, and in some instances, the underlying continuous noise that may include ambient noise, the noise attenuator 104 substantially removes or dampens the rain noise and/or the continuous noise from the unvoiced and mixed voice signals. The voice enhancement logic 100 encompasses any system that substantially removes, dampens, or reduces rain noise across a desired frequency spectrum. Examples of systems that may dampen or remove rain noise include systems that use a signal and a noise estimate such as (1) systems which use a neural network mapping of a noisy signal and an estimate of the noise to a noise-reduced signal, (2) systems that subtract the noise estimate from a noisy-signal, (3) systems that use the noisy signal and the noise estimate to select a noise-reduced signal from a code-book, (4) systems that in any other way use the noisy signal and the noise estimate to create a noise-reduced signal based on a reconstruction of the masked signal. These systems may attenuate rain noise, and in some instances, attenuate the continuous noise that may be part of the short-term spectra. The noise attenuator 104 may also interface or include an optional residual attenuator 106 that removes or dampens artifacts that may be introduced into the processed signal. The residual attenuator 106 may remove the "musical noise," squeaks, squawks, chirps, clicks, drips, pops, tones, or other sound artifacts.

Figure 2:
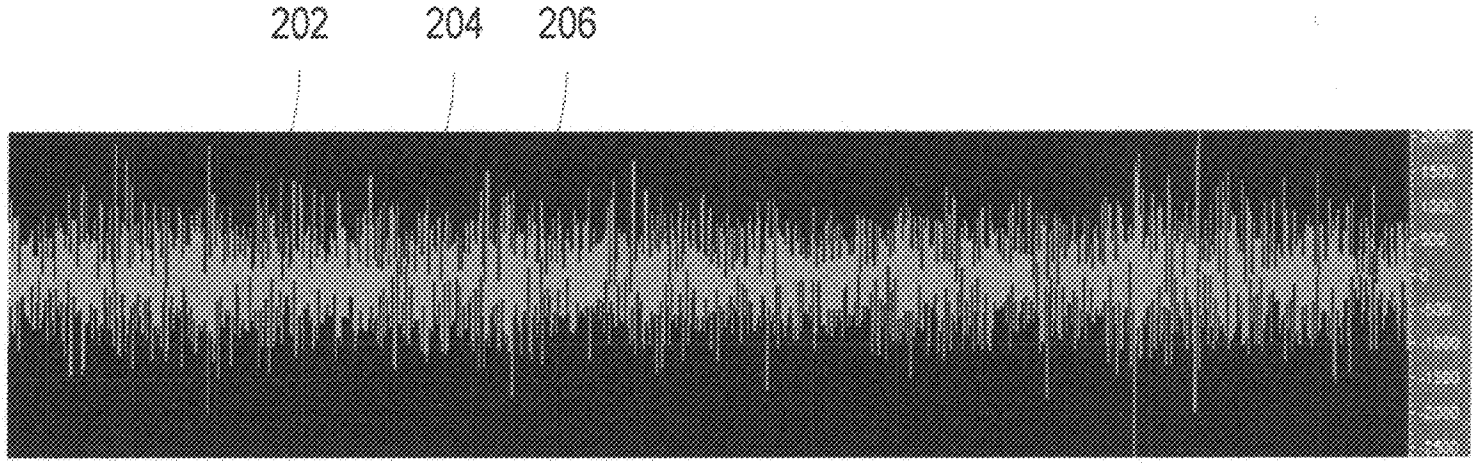
FIG. 2 is a time series plot of noise associated with rain and other sources.

FIG. 2 illustrates an exemplary frame of voice speech and a noisy signal created by water condensed from atmospheric vapor and falling in drops onto a surface. The rain pulses 202, 204, and 206 include the sound created by the rain striking a surface. The amplitudes of the rain pulses 202, 204, and 206 reflect the relative differences in power or intensity of rain striking a surface as detected by a receiver or a detector. In a vehicle, the rain pulses 202, 204, and 206 may represent the sound created when natural flowing water strikes a surface such as a window or the sound created when water conveyed under a pressure strikes a surface. The continuous noise shown in FIG. 2 may include an ambient noise, a noise associated with an engine, a noise created by a powertrain, a road noise, tire noise, other vehicle noises, or any other sounds.

Figure 3:
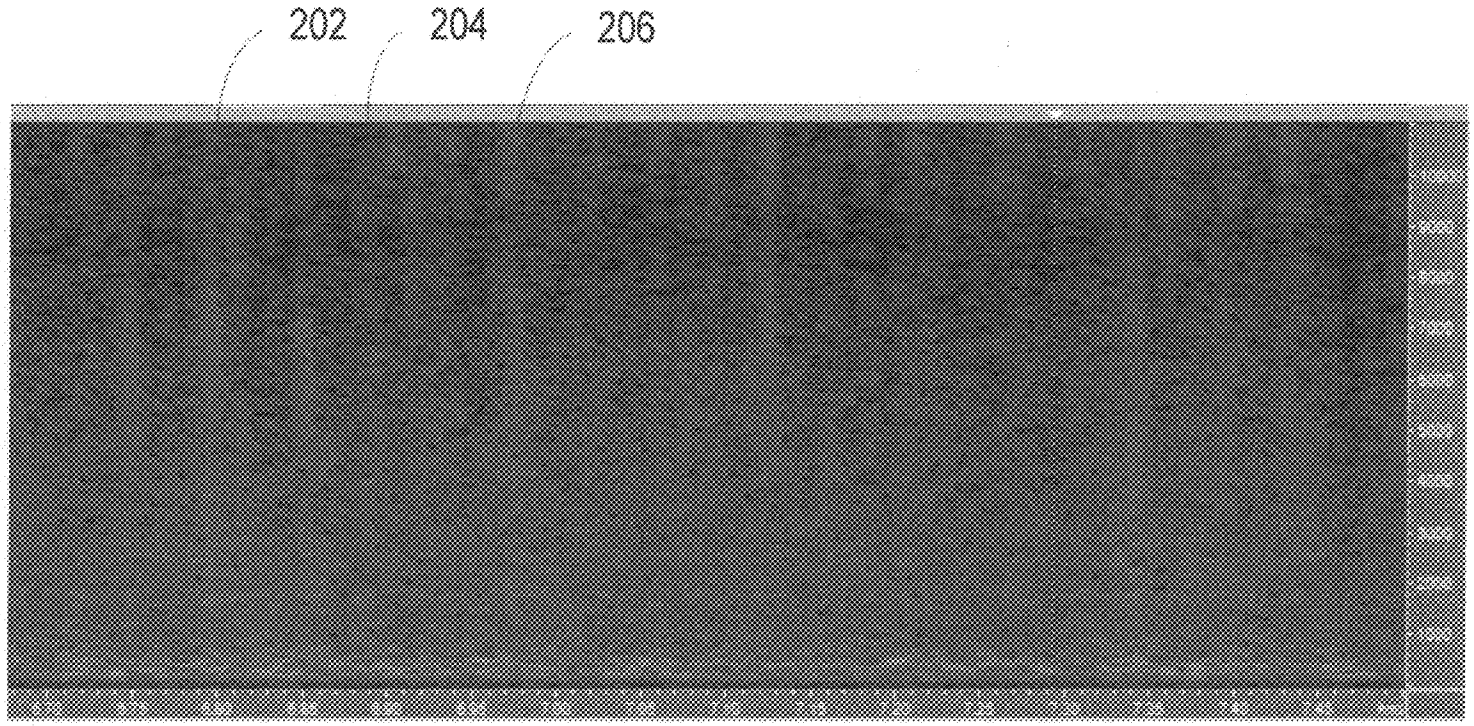
FIG. 3 is a is a time-frequency plot of noise associated with rain and other sources.

In the frequency spectral domain shown in FIG. 3, the continuous noise and rain pulses 202 204 and 206 may range from a substantially linear pulse to a curvilinear pulse. The substantially vertical lines of the raindrop transients shown in FIG. 3 may not be perfectly straight. Variances may be due to inherent distortion in the rain noise detector 102, the acoustics of the vehicle, and other sources. In some rain noise detectors 102 or the devices that may interface the rain noise detector 102, the circuits or hardware that converts sound waves into analog signals or convert the sound waves into digital data may distort the rain drop data. The shape of the rain drop transients may change as the signal is detected by or processed by such circuits. This distortion may result in loss of information. In some voice enhancement logic, the distortion may be learned and encoded allowing some of the noise attenuators 104 to substantially remove, dampen, or reduce the distortion.

Figure 4:
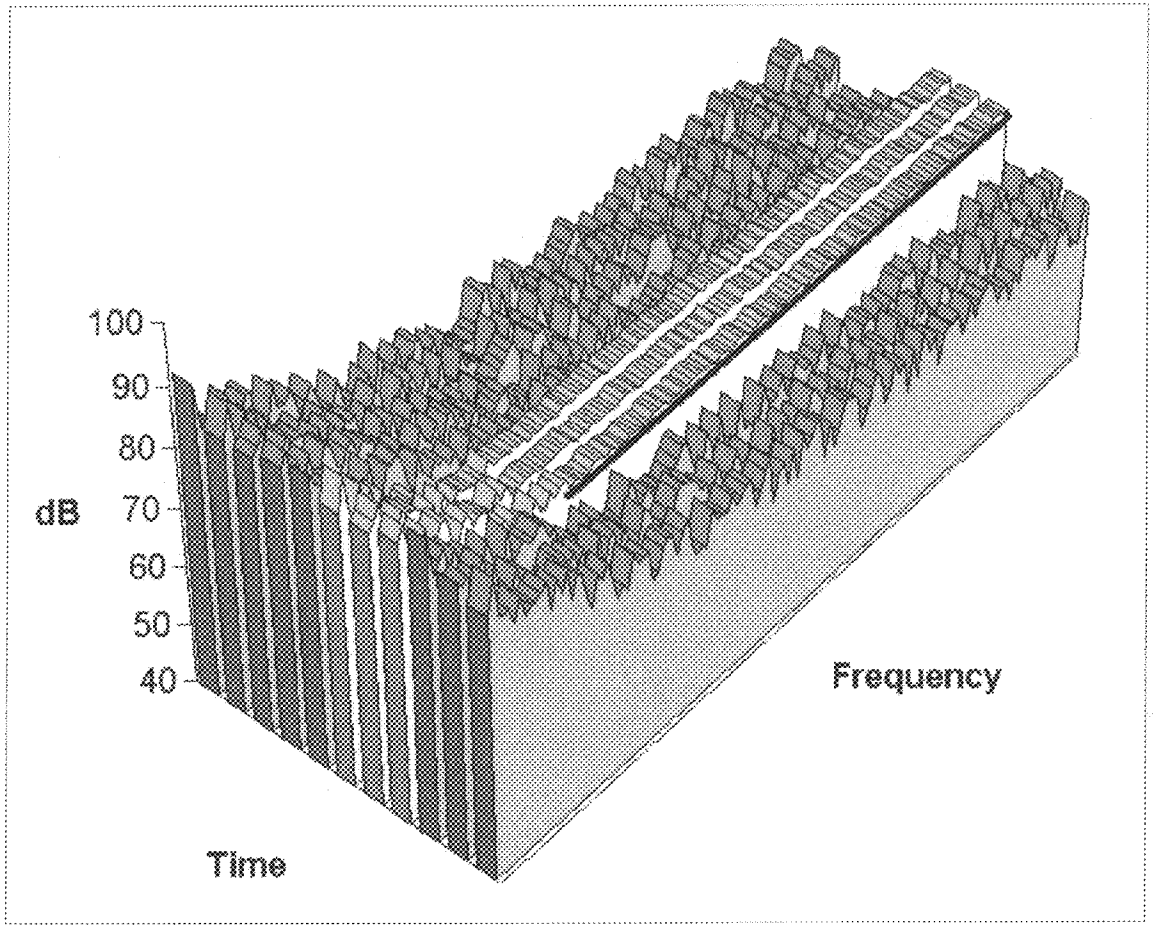
FIG. 4 is a waterfall plot of simulated noises of rain and other sources.

Rain drop detection may occur by monitoring segments of frequency forward and/or backward in time. Filter banks or Fast Fourier Transforms ("FFT") may transform sound into the log frequency domain. Through a comparison, the rain noise detector 102 identifies the frames that have substantially more energy than their adjacent frequency bands or frames. If a frequency band in a frame has higher energy than in an adjacent frame, the rain noise detector 102 looks for other frequency bands that also have more energy than in their neighboring frames. When the energy within these frequency bands can fit to a model such as straight line as shown in FIG. 4 or what may resemble a straight line, the rain noise detector 102 identifies the band as potential rain events. In some rain noise detectors 102 rain events may occur when the dispersion or variation of the energy relative to the line (e.g., the standard deviation) is within a predetermined or programmable range. Bands showing energy over neighbor but which are appreciably higher than the model may not be considered to be part of the rain drop noise.

Once the relative magnitudes and durations of the rain drop transients are learned, their removal may be accomplished by many methods. In one method, the noise attenuator 104 replaces the rain drop transient with an estimated value based on the values of adjacent frames. The interpolation method may occur with one or more frames positioned backward and/or forward in time and may impose predetermined restrictions and/or prior constraints. In an alternative method, the noise attenuator 104 adds the learned positions and frequencies to a known or measured constant noise estimate. The noise attenuator 104 then subtracts the noise estimate that includes the modeled rain noise from the noisy signal.

Figure 5:
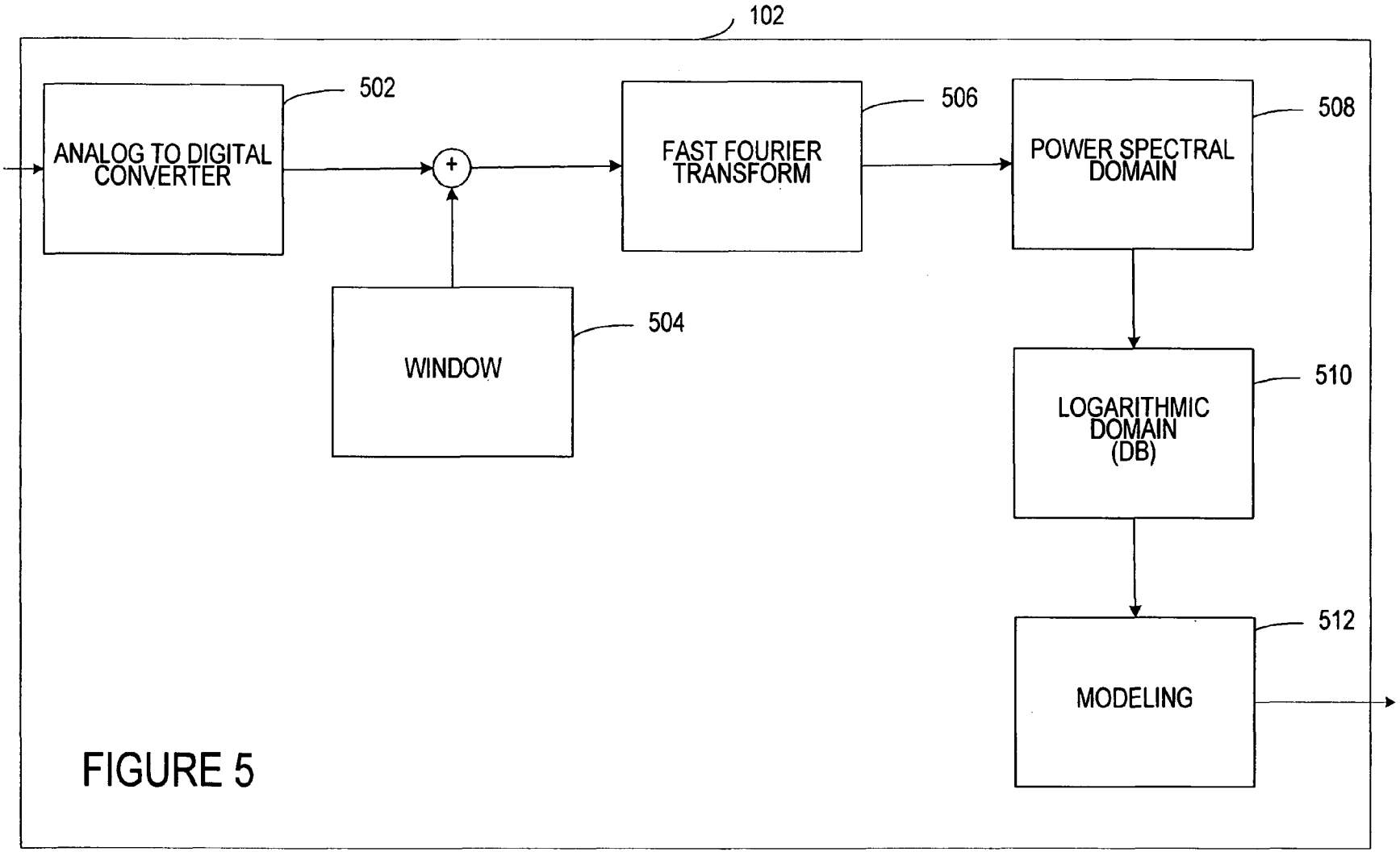
FIG. 5 is a block diagram of the voice enhancement logic of FIG. 1.

FIG. 5 is a block diagram of an example rain noise detector 102 that may receive or detect an unvoiced, fully voiced, or a mixed voice input signal. A received or detected signal is digitized at a predetermined frequency. To assure a good quality voice, the voice signal is converted to a pulse-code-modulated (PCM) signal by an analog-to-digital converter 502 (ADC) having any common sample rate. A smooth window 504 is applied to a block of data to obtain the windowed signal. The complex spectrum for the windowed signal may be obtained by means of a Fast Fourier Transform (FFT) 406 or a filter bank that separates the digitized signals into frequency bins, with each bin identifying an amplitude and phase across a small frequency range. Each frequency bin may then be converted into the power-spectral domain 508 and logarithmic domain 510 to develop a rain noise estimate with or without a continuous noise estimate. As more windows of sound are processed, the rain noise detector 102 may derive average rain noise estimates. A time-smoothed or weighted average may be used to estimate the rain noise with or without a continuous noise estimate for each frequency bin.

To detect a rain event, a line may be fitted to a selected portion of the frequency spectrum. Through a regression, a best-fit line may measure the severity of the rain noise within a given block of data. A high correlation between the best-fit line and the selected frequency spectrum may identify a rain noise event. Whether or not a high correlation exists, may depend on variations in frequency and amplitude of the rain noise and the presence of voice or other noises.

To limit a masking of voice, the fitting of the line to a suspected rain noise signal may be constrained by rules. Exemplary rules may prevent a calculated parametric description such as an offset, a slope, a curvature or a coordinate point in a rain noise model from exceeding an average value. Another rule may adjust or modulate the rain noise correction to prevent the noise attenuator 104 from applying a calculated rain noise correction when a vowel or another harmonic structure is detected. A harmonic may be identified by its narrow width and its sharp peak, or in conjunction with a voice or a pitch detector. If a vowel or another harmonic structure is detected, the rain noise detector 102 may limit the rain noise correction to values less than or equal to predetermined or average values. An additional rule may allow the average rain noise model or its attributes to be updated only during unvoiced segments. If a voiced or a mixed voice segment is detected, the average rain noise model or its attributes are not updated under this rule. If no voice is detected, the rain noise model or each attribute may be updated through any means, such as through a weighted average or a leaky integrator. Many other rules may also be applied to the model. The rules may provide a substantially good linear fit to a suspected rain noise event without masking a voice segment.

Figure 9:
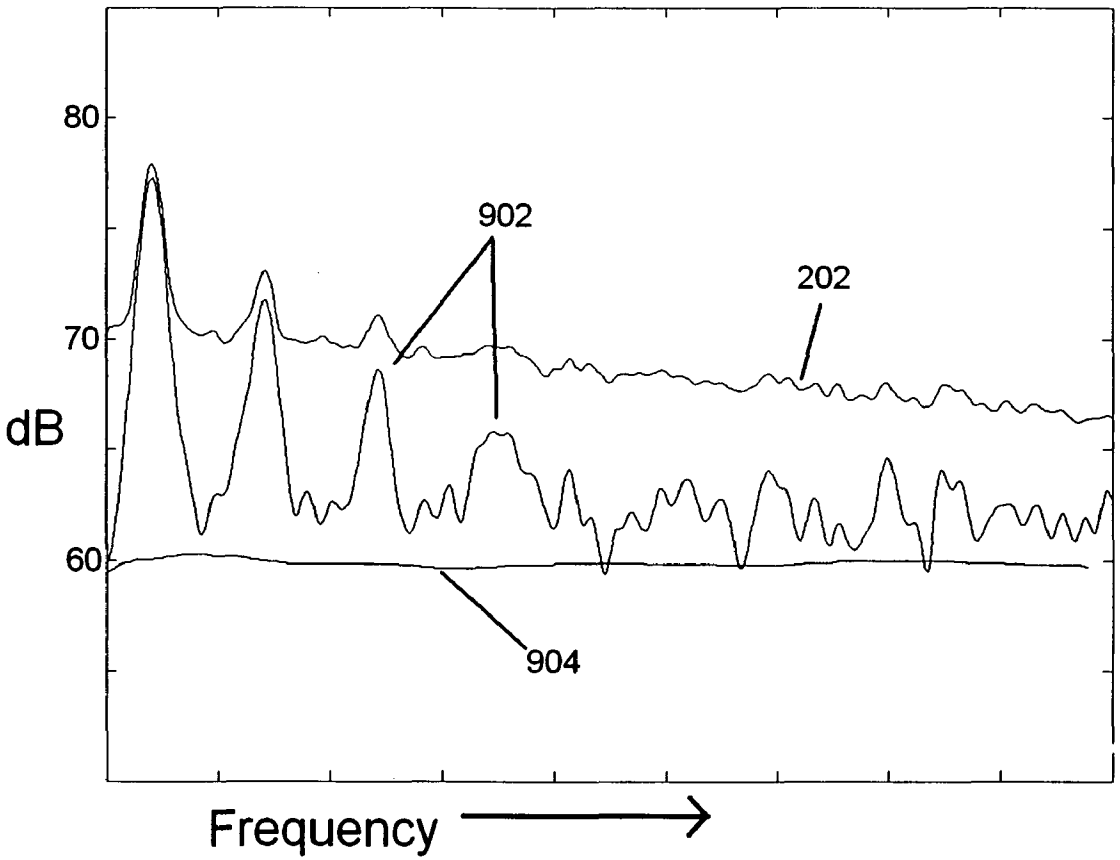
FIG. 9 is a graph of a rain noise masking a portion of a voice signal.
Figure 10:
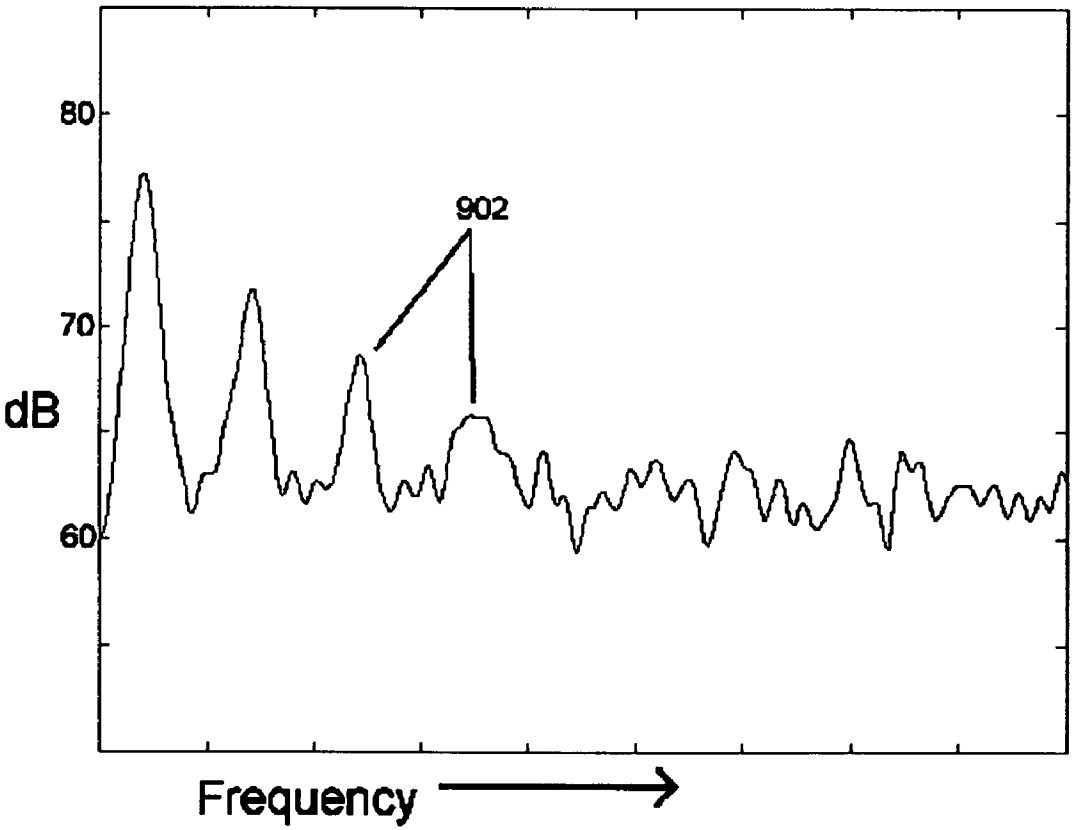
FIG. 10 is a graph of a processed and reconstructed voice signal.

To overcome the effects of rain noise, a rain noise attenuator 104 may substantially remove or dampen the rain noise from the noisy spectrum by any method. One method may add the rain noise model to a recorded or modeled continuous noise 904. In the power spectrum, the modeled noise may then be subtracted from the unmodified spectrum. If an underlying peak 902 or valley is masked by rain noise as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. An inverse FFT, filter bank, may then be used to convert the signal power to the time domain, which provides a reconstructed voice signal. Alternatively, the signal may be transformed into another frequency transform such as Mel frequency cepstral coefficients.

To minimize the "music noise," squeaks, squawks, chirps, clicks, drips, pops, tones, or other sound artifacts that may be generated in a selected frequency range by some rain noise attenuators, an optional residual attenuator 106 (shown in FIG. 1) may also condition the voice signal before or after it is converted to the time domain. The residual attenuator 106 may track the power spectrum within a selected frequency range such as the mid to high frequency range (e.g., more than about 1000 Hz). When a large increase in signal power is detected an improvement may be obtained by limiting or dampening the transmitted power in that range to a predetermined or calculated threshold. A calculated threshold may be equal to, or based on, the average spectral power of that same frequency range at an earlier period in time.

Figure 6:
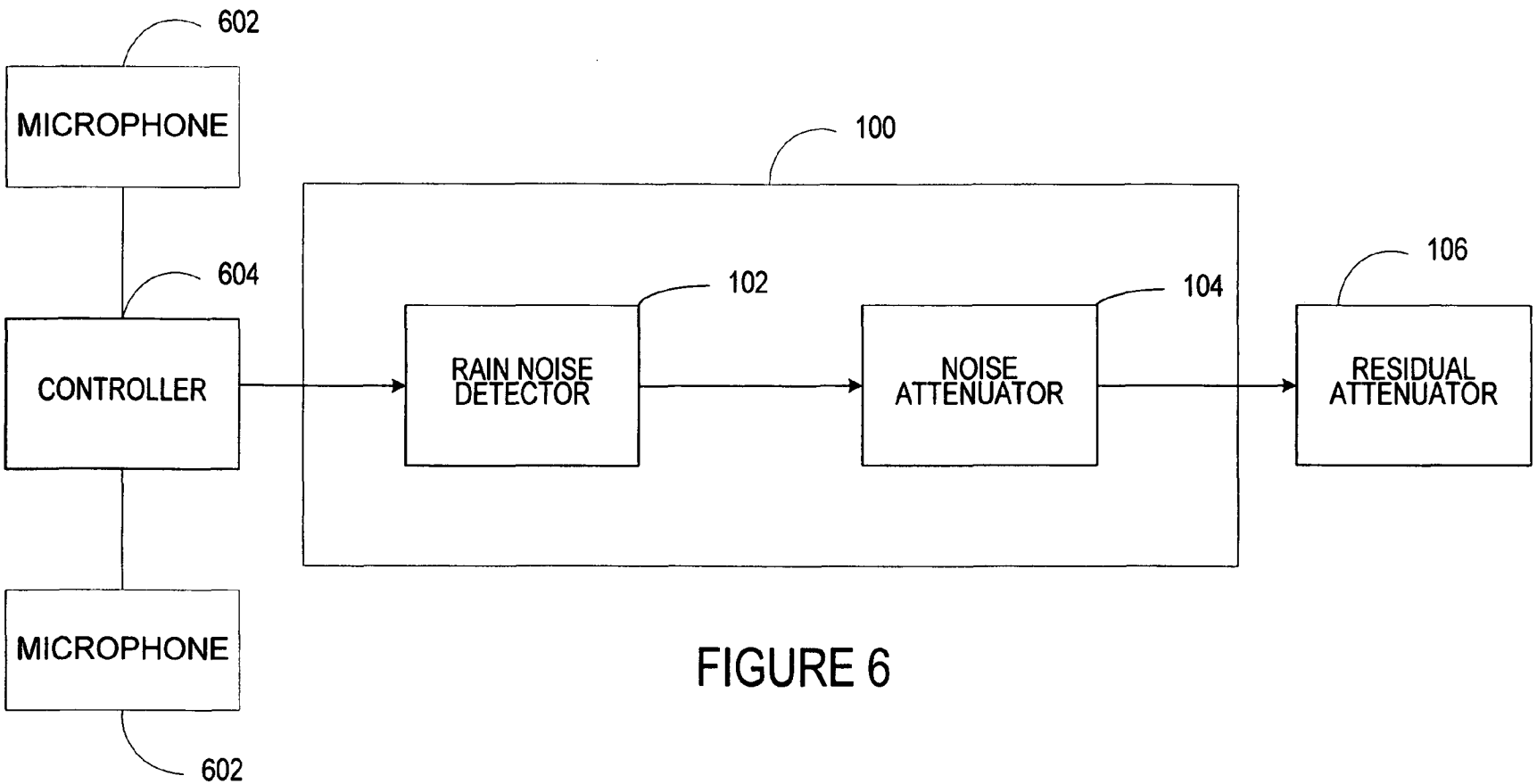
FIG. 6 is a pre-processing system coupled to the voice enhancement logic of FIG. 1.

Further improvements to voice quality may be achieved by pre-conditioning the input signal before the rain noise detector 102 processes it. One pre-processing system may exploit the lag time that a signal may arrive at different detectors that are positioned apart as shown in FIG. 6. If multiple detectors or microphones 602 are used that convert sound into an electric signal, the pre-processing system may include control logic 604 that automatically selects the microphone 602 and channel that senses the least amount of rain noise. When another microphone 602 is selected, the electric signal may be combined with the previously generated signal before being processed by the rain noise detector 102.

Figure 7:
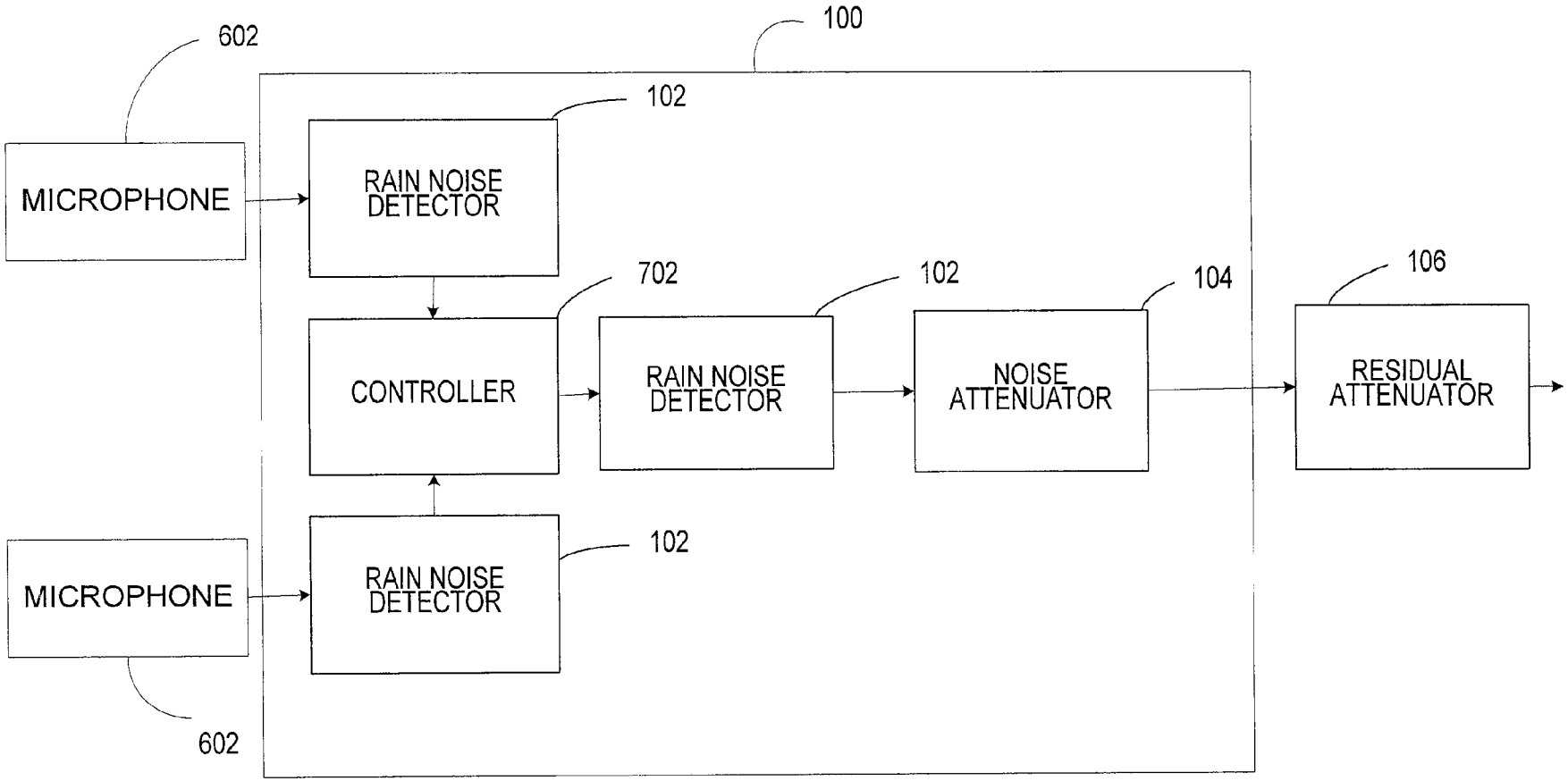
FIG. 7 is an alternative pre-processing system coupled to the voice enhancement logic of FIG. 1.

Alternatively, multiple rain noise detectors 102 may be used to analyze the input of each of the microphones 602 as shown in FIG. 7. Spectral rain noise estimates may be made on each of the channels. A mixing of one or more channels may occur by switching between the outputs of the microphones 602. The signals may be evaluated and selected on a frequency-by-frequency basis. Alternatively, control logic 702 may combine the output signals of multiple rain noise detectors 102 at a specific frequency or frequency range through a weighting function.

Figure 8:
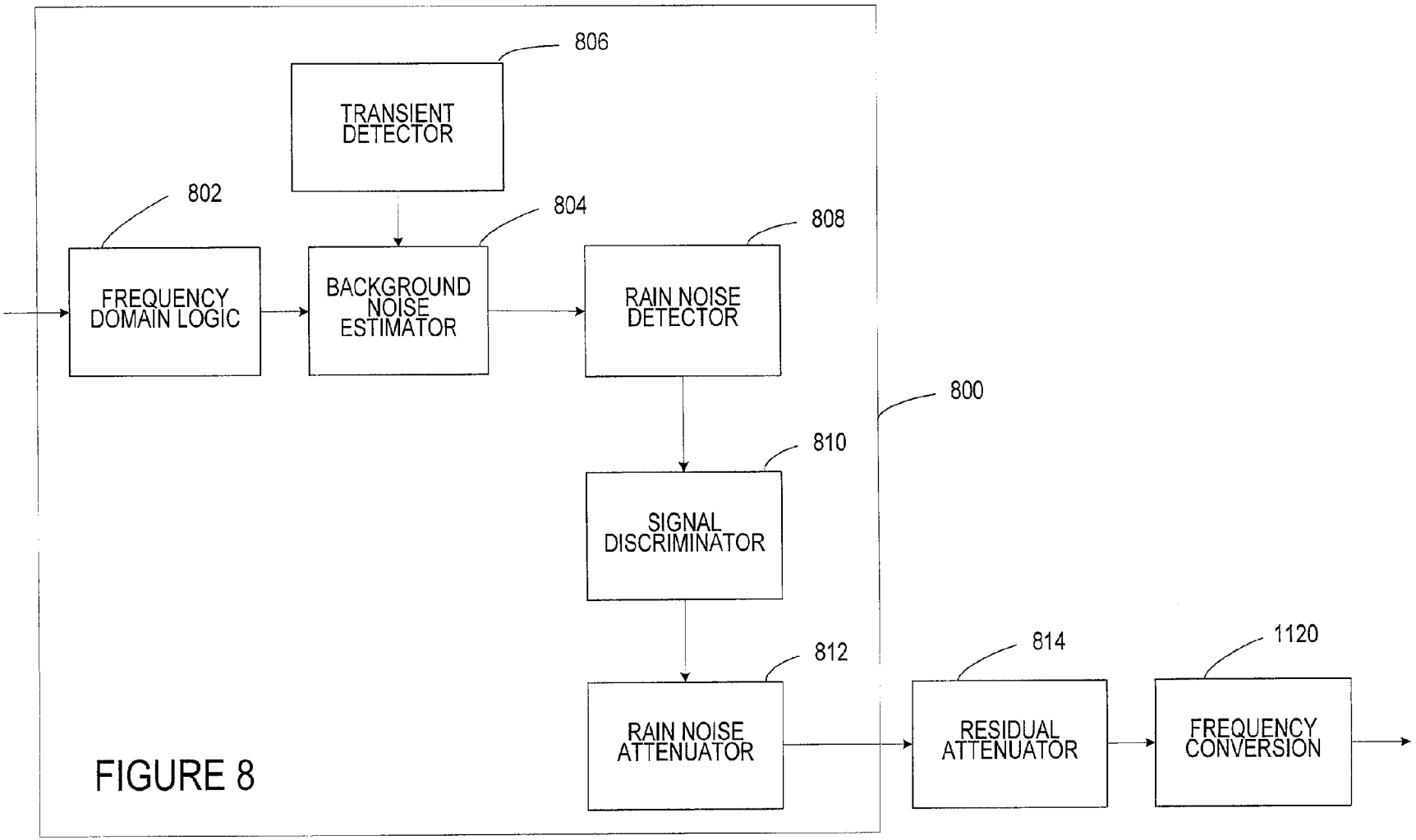
FIG. 8 is a block diagram of an alternative voice enhancement system.

FIG. 8 is alternative voice enhancement logic 800 that also improves the perceptual quality of a processed voice. The enhancement is accomplished by time-frequency transform logic 802 that digitizes and converts a time varying signal to the frequency domain. A background noise estimator 804 measures the continuous or ambient noise that occurs near a sound source or the receiver. The background noise estimator 804 may comprise a power detector that averages the acoustic power in each frequency bin. To prevent biased noise estimations at non-periodic transients, a transient detector 806 disables the noise estimation process during unexpected or unpredictable increases in power. In FIG. 8, the transient detector 806 may disable the background noise estimator 704 when an instantaneous background noise B(f, i) exceeds an average background noise $B_{(f)Ave}$ by more than a selected decibel level 'c.' This relationship may be expressed as:

$$B(f,i)>B_{(f)Ave}+c \quad \text{(Equation 1)}$$

To detect a rain event, a rain noise detector 708 may fit a line to a selected portion of the spectrum. Through a regression, a best-fit line may model the severity of the rain noise 202. To limit any masking of voice, the fitting of the line to a suspected range of rain noise may be constrained by the rules described above. A rain event may be identified when a high correlation between a fitted line and the noise associated with rain is detected. Whether or not a high correlation exists, may depend on a desired clarity of a processed voice and the variations in frequency and amplitude of the rain noise.

Alternatively, a rain event may be identified by the analysis of time varying spectral characteristics of the input signal that may be graphically displayed on a spectrogram. A spectrogram is a two dimensional pattern as shown in FIG. 3 in which the vertical dimensions correspond to frequency and the horizontal dimensions correspond to time.

A signal discriminator 810 may mark the voice and noise of the spectrum in real or delayed time. Any method may be used to distinguish voice from noise. In FIG. 7, voiced signals may be identified by (1) the narrow widths of their bands or peaks; (2) the resonant structure that may be harmonically related; (3) the resonances or broad peaks that correspond to formant frequencies; (4) characteristics that change relatively slowly with time; (5) their durations; and when multiple detectors or microphones are used, (6) the correlation of the output signals of the detectors or microphones, and many other attributes and/or combinations.

To overcome the effects of rain noise, a rain noise attenuator 812 may dampen or substantially remove the rain noise from the noisy spectrum by any method. One method may add the periodic rain noise pulses to a recorded or modeled continuous noise. In the power spectrum, the modeled noise may then be removed from the unmodified spectrum by the means described above. If an underlying peak or valley 902 is masked by rain noise 202 as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. A time series synthesizer may then be used to convert the signal power to the time domain, which provides a reconstructed voice signal.

To minimize the "musical noise," squeaks, squawks, chirps, clicks, drips, pops, tones, or other sound artifacts that may be generated in a selected frequency range by some rain noise attenuators, an optional residual attenuator 814 may also be used. The residual attenuator 814 may track the power spectrum within a frequency range. When a large increase in signal power is detected an improvement may be obtained by limiting the transmitted power in the frequency range to a predetermined or calculated threshold. A calculated threshold may be equal to or based on the average spectral power of that same frequency range at a period earlier or later in time.

Figure 11:
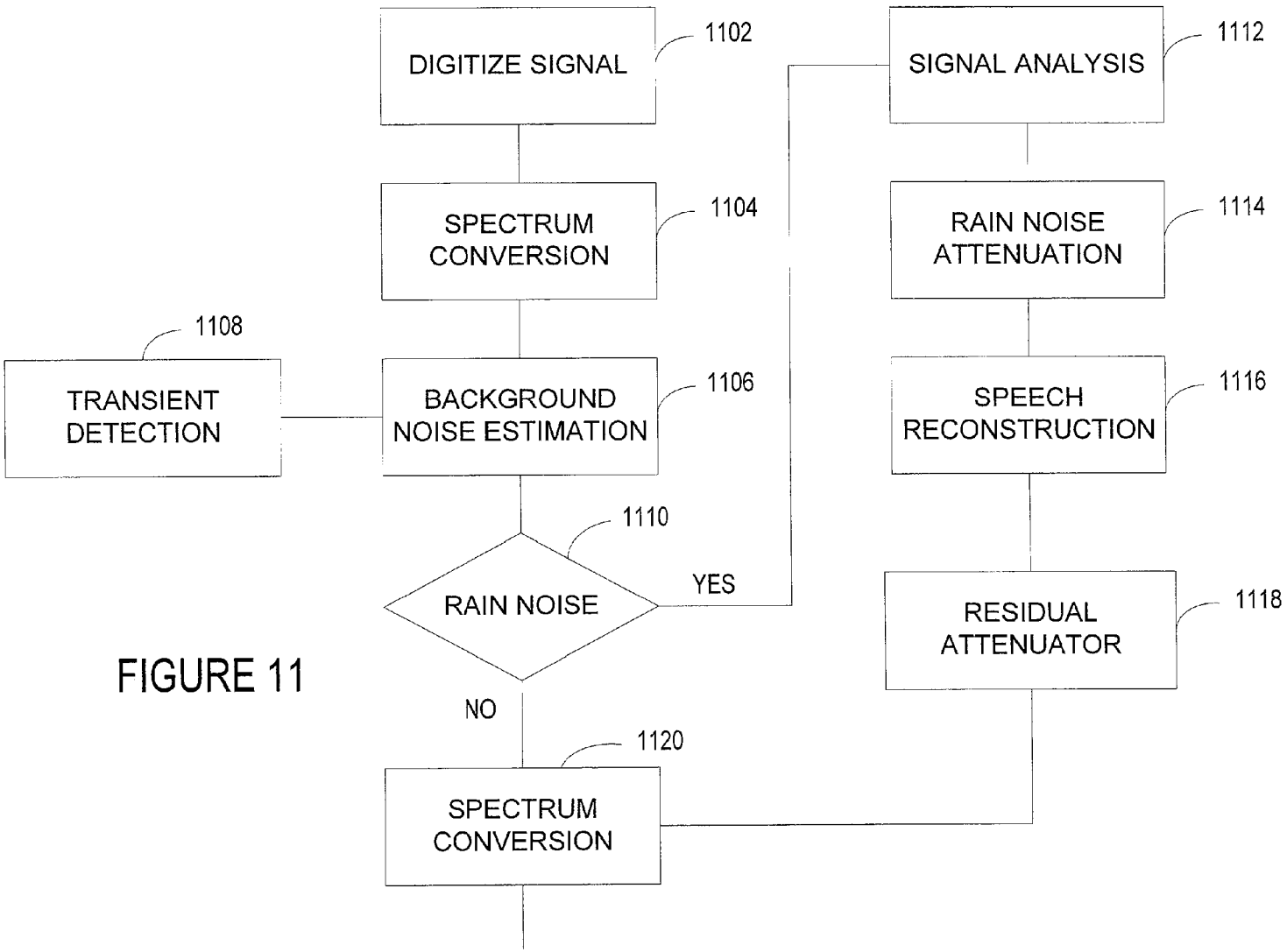
FIG. 11 is a flow diagram of a voice enhancement.

FIG. 11 is a flow diagram of a voice enhancement that removes some rain noise and continuous noise to enhance the perceptual quality of a processed voice. At act 1102 a received or detected signal is digitized at a predetermined frequency. To assure a good quality voice, the voice signal may be converted to a PCM signal by an ADC. At act 1104 a complex spectrum for the windowed signal may be obtained by means of an FFT or filter bank that separates the digitized signals into frequency bins, with each bin identifying an amplitude and a phase across a small frequency range.

At act 1106, a continuous or ambient noise is measured. The background noise estimate may comprise an average of the acoustic power in each frequency bin. To prevent biased noise estimations at transients, the noise estimation process may be disabled during abnormal or unpredictable increases in power at act 1108. The transient detection act 1108 disables the background noise estimate when an instantaneous background noise exceeds an average background noise by more than a predetermined decibel level.

At act 1110, a rain event may be detected when a high correlation exits between a best-fit line and a selected portion of the frequency spectrum. Alternatively, a rain event may be identified by the analysis of time varying spectral characteristics of the input signal. When a line fitting detection method is used, the fitting of the line to the suspected rain signal may be constrained by some optional acts. Exemplary optional acts may prevent a calculated offset, slope, or coordinate point in a rain noise model from exceeding an average value. Another optional act may prevent the rain noise detection method from applying a calculated rain noise correction when a vowel or another harmonic structure is detected. If a vowel or another harmonic structure is detected, the rain noise detection method may limit the rain noise correction to values less than or equal to predetermined or average values. An additional optional act may allow the average rain noise model or attributes to be updated only during unvoiced segments. If a voiced or mixed voice segment is detected, the average rain noise model or attributes are not updated under this act. If no voice is detected, the rain noise model or each attribute may be updated through many means, such as through a weighted average or a leaky integrator. Many other optional acts may also be applied to the model.

At act 1112, a signal analysis may discriminate or mark the voice signal from the noise-like segments. Voiced signals may be identified by any means including, for example, (1) the narrow widths of their bands or peaks; (2) the resonant structure that may be harmonically related; (3) their harmonics that correspond to formant frequencies; (4) characteristics that change relatively slowly with time; (5) their durations; and when multiple detectors or microphones are used, (6) the correlation of the output signals of the detectors or microphones.

To overcome the effects of rain noise, a rain noise is substantially removed or dampened from the noisy spectrum by any act. One exemplary act 1114 adds the substantially periodic rain pulses to a recorded or modeled continuous noise. In the power spectrum, the modeled noise may then be substantially removed from the unmodified spectrum by the methods and systems described above. If an underlying peak or valley 902 is masked by a rain event 202 as shown in FIG. 9 or masked by a continuous noise 902, a conventional or modified interpolation method may be used to reconstruct the peak and/or valley at act 1116. A time series synthesis may then be used to convert the signal power to the time domain at act 1120, which provides a reconstructed voice signal.

To minimize the "musical noise," squeaks, squawks, chirps, clicks, drips, pops, frequency tones, or other sound artifacts that may be generated in the selected frequency range by some rain noise removal processes, a residual attenuation method may also be performed before the signal is converted back to the time domain. An optional residual attenuation method 1118 may track the power spectrum within a frequency range. When a large increase in signal power is detected an improvement may be obtained by limiting the transmitted power in that frequency range to a predetermined or calculated threshold. A calculated threshold may be equal to or based on the average spectral power of that same frequency range at a period earlier or later in time.

The method shown in FIG. 11 may be encoded in a signal bearing medium, a computer readable medium such as a memory, programmed within a device such as one or more integrated circuits, or processed by a controller or a computer. If the methods are performed by software, the software may reside in a memory resident to or interfaced to the rain noise detector 102, noise attenuator 104, a communication interface, or any other type of non-volatile or volatile memory interfaced or resident to the voice enhancement logic 100 or 800. The memory may include an ordered listing of executable instructions for implementing logical functions. A logical function may be implemented through digital circuitry, through source code, through analog circuitry, or through an analog source such through an analog electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

From the foregoing descriptions it should be apparent that the above-described systems may also condition signals received from only one microphone or detector. It should also be apparent, that many combinations of systems may be used to identify and track rain events. Besides the fitting of a line to a suspected rain event, a system may (1) detect periodic peaks in the spectra having a SNR greater than a predetermined threshold; (2) identify the peaks having a width greater than a predetermined threshold; (3) identify peaks that lack a harmonic relationships; (4) compare peaks with previous voiced spectra; and (5) compare signals detected from different microphones before differentiating the rain noise segments, other noise like segments, and regular harmonic structures. One or more of the systems described above may also be used in alternative voice enhancement logic.

Other alternative voice enhancement systems include combinations of the structure and functions described above. These voice enhancement systems are formed from any combination of structure and function described above or illustrated within the attached figures. The logic may be implemented in software or hardware. The term "logic" is intended to broadly encompass a hardware device or circuit, software, or a combination. The hardware may include a processor or a controller having volatile and/or non-volatile memory and may also include interfaces between devices through wireless and/or hardwire mediums. The wireless interfaces may utilize Zigbee, Wi-Fi, WiMax, Mobile-Fi, Ultrawideband, Bluetooth, cellular and any other wireless technologies or combination.

Figure 12:
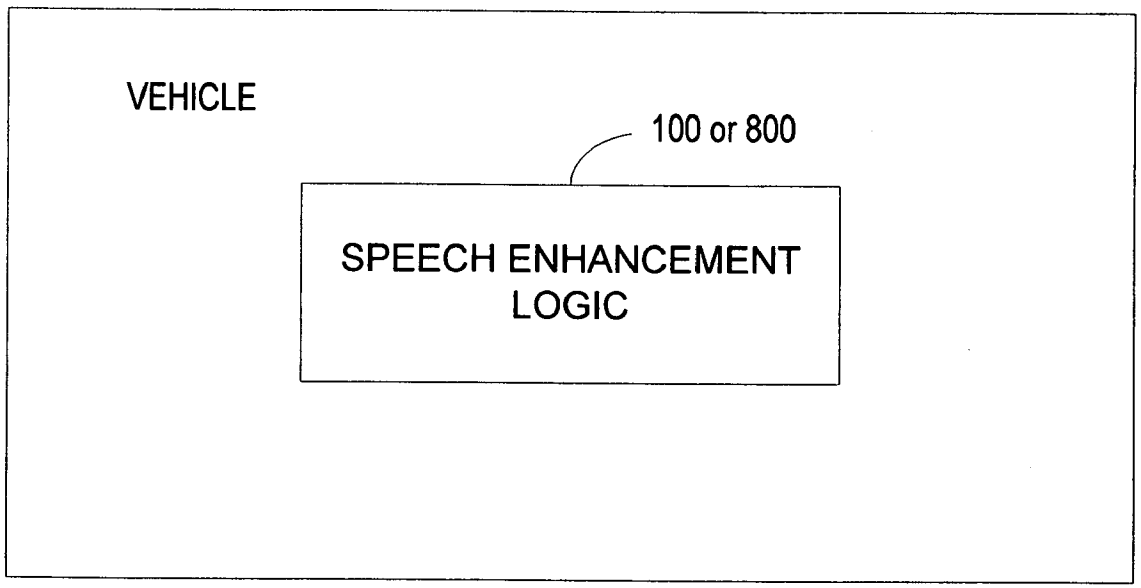
FIG. 12 is a block diagram of voice enhancement logic within a vehicle.
Figure 13:
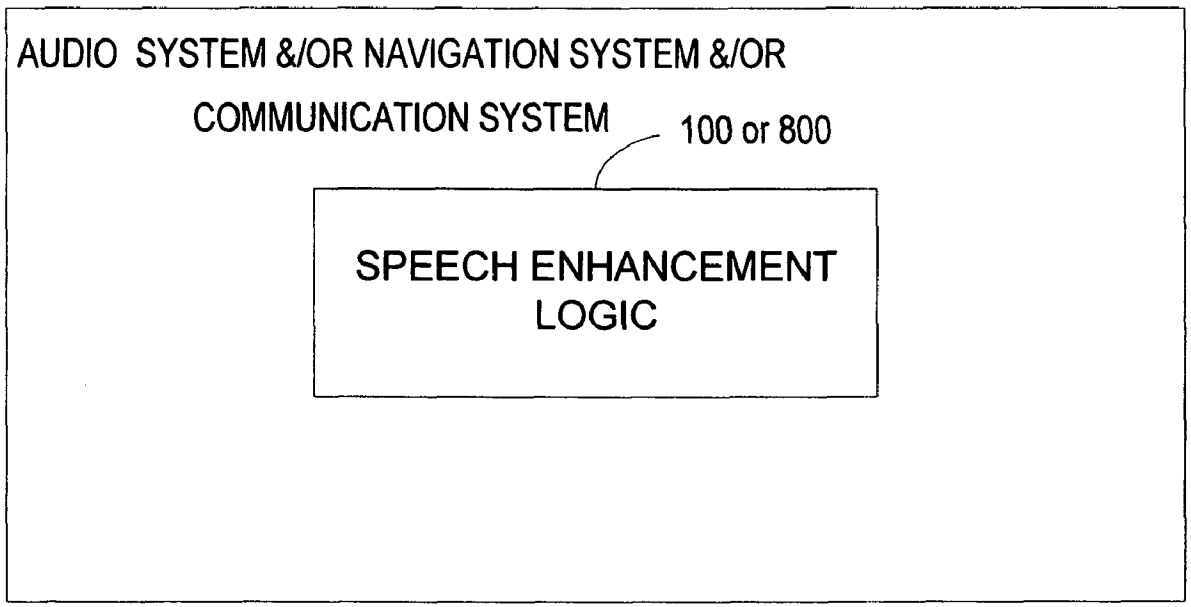
FIG. 13 is a block diagram of voice enhancement logic interfaced to an audio system and/or a navigation system and/or a communication system.
Figure 14:
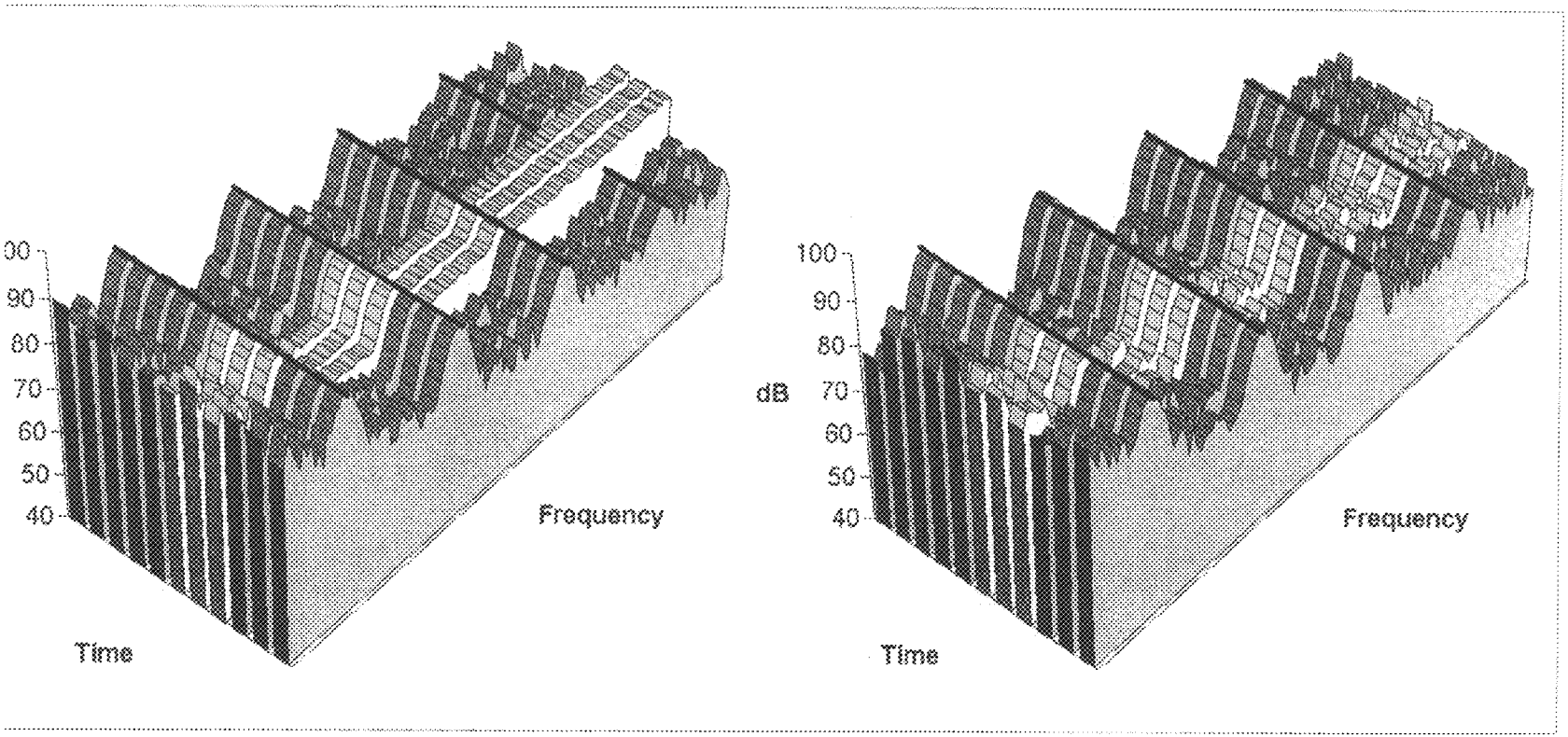
FIG. 14 are waterfall plots of simulated voice combined with noises of rain and other sources.

The voice enhancement logic is easily adaptable to any technology or devices. Some voice enhancement systems or components interface or couple devices or structures for transporting people or things such as the vehicle shown in FIG. 12. Some voice enhancement systems or components interface or couple instruments that convert voice and other sounds into a form that may be transmitted to remote locations, such as landline and wireless devices, audio equipment, navigation equipment as shown in FIG. 13, and other communication systems that may be susceptible to rain noise.

The voice enhancement logic improves the perceptual quality of a processed voice. The logic may automatically learn and encode the shape and form of the noise associated with the movement of water and/or the noise associated with water striking a surface in a real or a delayed time. By tracking substantially all or some of the selected attributes, the logic may eliminate, dampen, or reduce the water related noise using a memory that temporarily or permanently stores the attributes of that noise. The voice enhancement logic may also dampen a continuous noise and/or the squeaks, squawks, chirps, clicks, drips, pops, tones, or other sound artifacts that may be generated within some voice enhancement systems and may reconstruct voice when needed.

Figure 15:
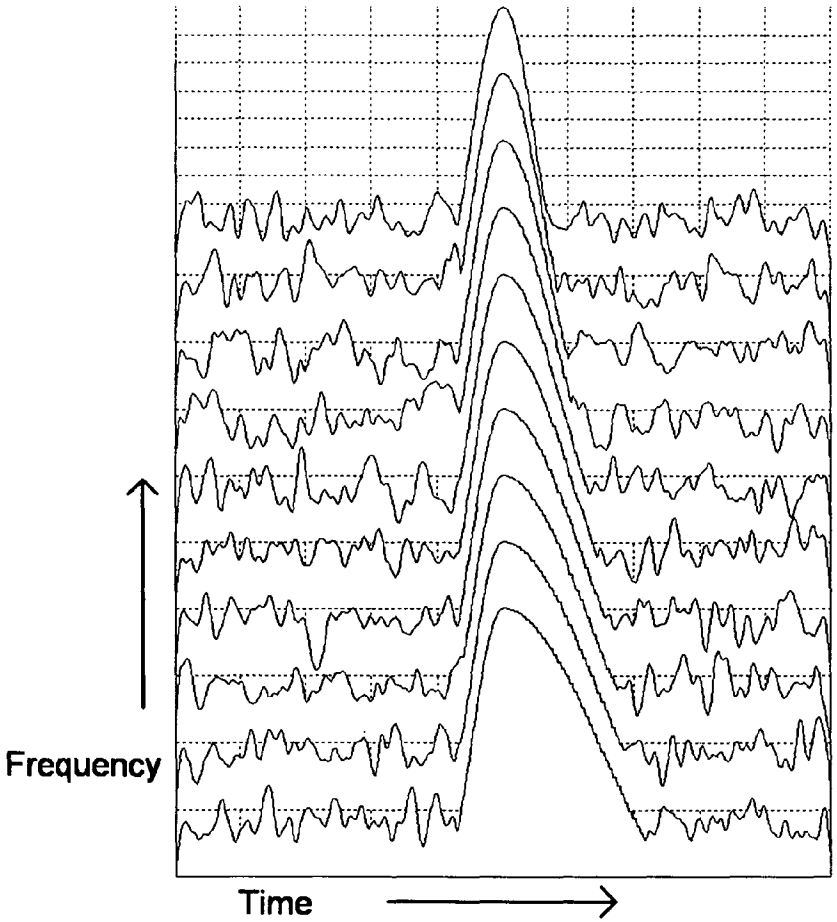
FIG. 15 is a simulated time-frequency plot showing a two-dimensional raindrop noise model.

Another alternate method of rain drop detection uses a two-dimensional model of rain drop intensity in both time and frequency. An example of a possible time-frequency model for rain drop detection is shown in FIG. 15. Because rain drop noise may be wide-band, substantially similar intensity-vs.-time profiles may be expected in the frequency ranges involved in the raindrop event. All frequencies involved in the rain may plot rise at approximately the same time, but may have different peak values, durations, and decay rates. The rain detector may also consider that part of the rain drop may be masked by louder sounds, such as voice harmonics, and may partially or fully exclude these frequency ranges from the rain model. This exclusion may be explicit, by scanning for probable non-rain features before modeling, or implicit, by choosing a modeling method that allows values to significantly exceed the selected model.

Detection may involve fitting a predefined rain model to the spectrum and determining the quality of the match, as well as possibly identifying which frequency ranges are involved in the rain drop event. The included frequency ranges may be continuous or discontinuous; in addition, all or part of the spectrum may be identified as being only partially involved in the raindrop event.

Some or all of the parameters used to model the rain drop noise may be constrained to be within predetermined and/or adaptive limits, which may be a function of frequency, presence of voice, characteristics of recently detected raindrops, average time between raindrops, or any other internal or external data which can be made available to the rain detector. In particular, these parameters may include rain drop duration, peak intensity, rise and fall rates, allowable intensity variation between different frequency ranges.

Because of the high intensity and short duration of a typical rain drop event, it may be desirable to attenuate or remove the raindrop before the entire event has been observed; furthermore, in a real-time setting there may be limited or no future information available. A further refinement of this rain detection method is a method for estimating the likelihood of a rapid rise being part of a raindrop and estimating the raindrop model parameters without complete future information. In this case, the rate of energy increase, and the range of frequencies involved in the increase, may be used as a primary detection method. The expected duration and rate of decay in the estimated model may be used at a nearby future time to verify that the detected raindrop continues to fit the estimated model. In order to minimize the unwanted attenuation of the speech signal, the rain noise attenuator may discontinue or reduce attenuation if the raindrop does not behave as predicted. Alternatively, when a noise estimate removal method is being used, the rain drop model may simply decay as predicted and allow the signal to pass through unattenuated once the model drops below the level of the rain noise estimate.

Figure 16:
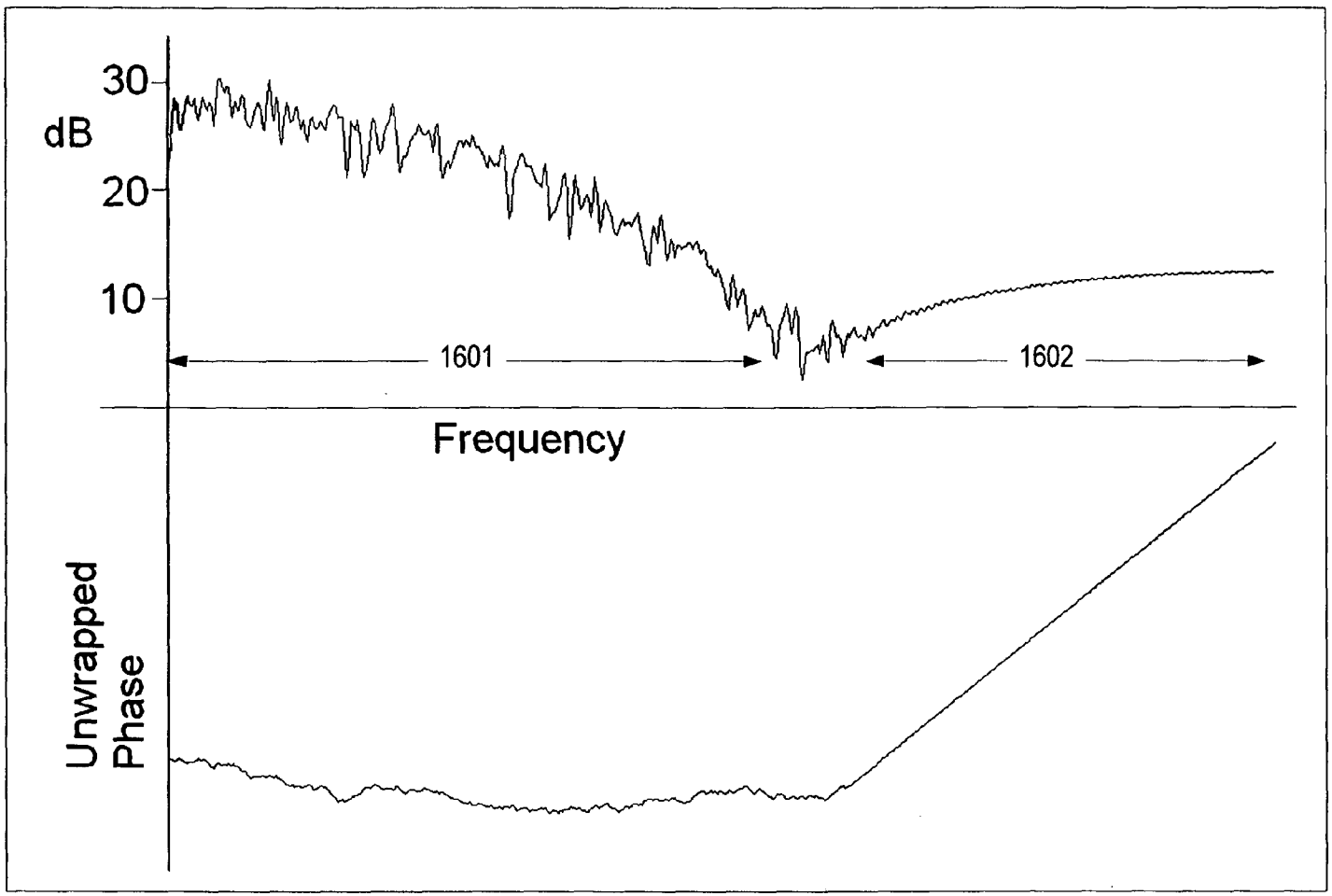
FIG. 16 is a combined frequency-magnitude and frequency-phase plot of a simulated frame containing raindrop noise.

A further refinement uses additional observed properties of raindrop spectra to assist the detector in distinguishing between rain and non-rain signals. One distinguishing feature of the rain drop noise may be the continuity of the magnitude and/or phase of its spectrum across many adjacent frequency bins. In FIG. 16, the portion of the spectrum dominated by rain noise 1602 has a significantly smoother magnitude plot than the portion dominated by other noise sources 1601.

Certain types of rain drop noise may have a significantly flatter and/or smoother magnitude than a spectrum containing voice or other speech sounds. One or more mathematical measures of a spectrum's flatness or smoothness may be used, on part or all of the spectrum, to improve the distinction between rain and voice spectra. This measure, which may be computed for the entire spectrum for predefined bands, or continuously using a sliding window across the entire spectrum, may be used to help decide whether a raindrop noise is present and how involved each frequency is in the raindrop.

An example of a smoothness measure is the sum of absolute differences algorithm, which computes the absolute value of the difference in magnitude or logarithmic magnitude between adjacent frequency bins, and summing this over a number of bins to produce a value that is generally small for smooth spectra and greater for spectra with large variations between the intensity of adjacent frequency bins. An example of a flatness measure is the Spectral Flatness Measure (SFM) which may be found by computing the ratio of the geometric mean of the magnitude spectrum to its arithmetic mean.

Phase continuity may also be used to distinguish rain drop noises from other sounds. The rain drop noise may be represented by a short high-energy burst in the time domain, and this may cause the unwrapped phases of the FFT result to be locally linear as illustrated in the phase plot in the portion of the spectrum dominated by rain noise 1602.

One method for determining the local linearity of phases is to take the absolute value of the second derivative of the unwrapped phase, then smoothing this in frequency. This measure may produce values close to zero for regions of the spectrum dominated by impulse-like noise and values significantly greater than zero in regions dominated by other types of sound, such as tonal sound or longer-duration noise. This measure may be used to assist with distinguishing transients such as rain drop noise from tonal or speech sounds.

In addition, the value of the slope in the linear part of the phase plot may be directly relatable to the position of the transient within the time-series signal, allowing a time-based detection or removal method to more precisely detect and/or remove the disturbance in the time domain.

The rain detection module may communicate with other devices in the vehicle to adjust the behavior of the rain detector and remover depending on the status of other systems in the vehicle (e.g. the windshield wiper controller). It may, for example, be desirable to enable the rain detection logic 102 only when the windshield wipers are switched on and/or to adjust the parameters of the rain drop model depending on the speed of the wipers. Conversely, the rain detector may transmit information about the intensity and average time between raindrop-like noises to the wiper controller, which may enhance its ability to intelligently control the wipers without driver intervention.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system for suppressing rain noise from a voiced or unvoiced signal, comprising:

a noise detector configured to fit a line to an input signal and identify whether a noise from the input signal is associated with rain based on a correlation between the line and the input signal, where the noise detector comprises a non-transitory medium or circuit; and a noise attenuator electrically connected to the noise detector to substantially remove noise associated with rain from the input signal.

2. The system for suppressing rain noise of claim 1 where the noise detector is configured to model a portion of the input signal.

3. The system of claim 1 where the noise detector is configured to model a rain event by calculating a correlation factor.

4. The system of claim 1 where the noise detector is configured to prevent one or more attributes of a modeled rain noise from exceeding a predefined value.

5. The system of claim 1 where the noise detector is configured to limit a rain noise correction when a vowel or a harmonic like structure is detected.

6. The system of claim 1 where the noise detector is configured to derive an average rain noise model and the average rain noise model is not updated when a voiced or a mixed voice signal is detected.

7. The system of claim 1 where the noise detector is configured to derive an average rain noise model that is derived by a weighted average of other modeled signals analyzed earlier in time.

8. The system of claim 1 where the noise attenuator is configured to substantially remove the noise associated with rain and a continuous noise from the input signal.

9. The system of claim 1 further comprising a residual attenuator coupled to the noise detector and the noise attenuator to dampen signal power in a frequency range when a large increase in a signal power is detected in the frequency range.

10. The system of claim 1 further including an input device coupled to the noise detector, the input device configured to convert sound waves into analog signals.

11. The system of claim 1 further including a pre-processing system coupled to the noise detector, the pre-processing system configured to pre-condition the input signal before the rain noise detector processes it.

12. The system of claim 11 where the pre-processing system comprises first and second microphones spaced apart and configured to exploit a lag time of a signal that may arrive at the different microphones.

13. The system of claim 12 further comprising control logic that automatically selects a microphone and a channel that senses the least amount of noise in the input signal.

14. The system of claim 12 where the noise detector comprises a first noise detector, the system further comprising a second noise detector coupled to the first noise detector and the first microphone.

15. A system for detecting rain noise from a voiced and unvoiced signal, comprising:

a time frequency transform logic that converts a time varying input signal into the frequency domain;

a background noise estimator coupled to the time frequency transform logic, the background noise estimator configured to measure the continuous noise that occurs near a receiver; and a rain noise detector coupled to the background noise estimator, the rain noise detector configured to derive a correlation between a line and a portion of the input signal to determine, based on the correlation, whether the portion of the input signal contains noise associated with rain.

16. The system of claim 15 further comprising a transient detector configured to disable the background noise estimator when a non-periodic transient signal is detected.

17. The system of claim 15 further comprising a signal discriminator coupled to the rain noise detector, the signal discriminator configured to identify voice and noise segments of the input signal.

18. The system of claim 15 further comprising a rain noise attenuator coupled to the rain noise detector, the rain noise attenuator configured to reduce the noise associated with the rain that is sensed by the receiver.

19. The system of claim 18 where the noise attenuator is configured to substantially remove the noise associated with the rain from the input signal.

20. The system of claim 15 further comprising a residual attenuator coupled to the background noise estimator operable to dampen signal power in a frequency range when a large increase in signal power is detected in the frequency range.

21. A system for suppressing rain noise from a voiced or unvoiced signal, comprising:

a time frequency transform logic that converts a time varying input signal into the frequency domain;

a background noise estimator coupled to the time frequency transform logic, the background noise estimator configured to measure the continuous noise that occurs near a receiver;

a rain noise detector means coupled to the background noise estimator, the rain noise detector configured to fit a line to a portion of an input signal to identify whether the portion of the input signal contains a rain event; and a rain noise attenuator coupled to the rain noise detector means, the rain noise attenuator being configured to remove a noise associated with rain that is sensed by the receiver.

22. A method of dampening a noise associated with rain from an input signal comprising:

converting a time varying signal to a complex spectrum;

estimating a background noise;

fitting a line to a portion of the input signal;

identifying, by a noise detector that comprises a circuit, that a noise is associated with rain when a high correlation exists between the line and the portion of the input signal; and passing the input signal through a noise attenuator to dampen the noise associated with rain from the input signal to obtain a noise-reduced signal.

23. The method of claim 22 where the act of estimating the background noise comprises estimating the background noise when a non-periodic transient is not detected.

24. The method of claim 22 where the act of passing the input signal through the noise attenuator comprises substantially removing a rain noise from the input signal.

25. A method of removing rain noise from an input signal comprising:

converting a time varying signal to a complex spectrum;

estimating a background noise;

fitting a line to a portion of the input signal;

identifying that a noise is associated with rain, by a noise detector that comprises a computer processor that executes instructions stored on a non-transitory computer-readable medium to identify whether the noise is associated with rain, when a high correlation exists between the line and the portion of the input signal; and passing the input signal through a noise attenuator to remove the noise associated with rain from the input signal to obtain a noise-reduced signal.

26. A computer-readable storage medium having software embodied therein that controls a detection of a noise associated with water falling through the air, the software comprising:

a detector that converts sound waves into electrical signals;

a spectral conversion logic that converts the electrical signals from a first domain to a second domain; and a signal analysis logic that fits a line to a portion of the sound waves in the second domain, and where the signal analysis logic identifies whether the portion of the sound waves contains a rain event based on a correlation between the line and the portion of the sound waves in the second domain.

27. The medium of claim 26 further comprising logic that derives a portion of a voiced signal masked by noise.

28. The medium of claim 26 further comprising logic that attenuates a portion of the sound waves.

29. The medium of claim 26 further comprising attenuator logic operable to limit a power in a selected frequency range.

30. The medium of claim 26 further comprising noise estimation logic that measures a continuous or ambient noise sensed by the detector.

31. The medium of claim 30 further comprising a transient logic that disables the estimation logic when an increase in power is detected.

32. The medium of claim 26 where the signal analysis logic is coupled to an audio system of a vehicle.

33. The medium of claim 26 where the signal analysis logic models only the sound waves that are associated with rain.

34. The system of claim 1 where the noise detector is configured to identify that the input signal comprises a rain event when a high correlation exists between the line and the portion of the input signal.

35. The method of claim 22 where the act of fitting the line comprises fitting the line to the portion of the input signal to identify whether the portion of the input signal contains a rain event.

36. The method of claim 25 where the act of fitting the line comprises fitting the line to the portion of the input signal to identify whether the portion of the input signal contains a rain event.

37. A system for suppressing rain noise, comprising:

a rain noise detector that analyzes a detected sound to determine whether the detected sound contains a noise associated with rain, where the rain noise detector identifies multiple high-energy frequency bands in the detected sound that have higher energies than their adjacent frequency bands, where the rain noise detector compares the high-energy frequency bands to a model that corresponds to rain noise, where the rain noise detector identifies whether the high-energy frequency bands are associated with rain based on a fit between the model and the energy levels of the high-energy frequency bands, and where the rain noise detector comprises a non-transitory medium or circuit; and a rain noise attenuator coupled with the rain noise detector to dampen one or more portions of the detected sound that are identified by the rain noise detector as being associated with rain.

38. The system of claim 37 further comprising a background noise estimator coupled to the rain noise detector, the background noise estimator configured to measure a continuous noise that occurs near a receiver.

39. The system of claim 1 further comprising a background noise estimator coupled to the noise detector, the background noise estimator configured to measure a continuous noise that occurs near a receiver.

* * * * *